United States Patent [19]

Newby

[11] Patent Number: 4,838,437

[45] Date of Patent: Jun. 13, 1989

[54] MONORAIL AND FISHPLATE ASSEMBLY

[75] Inventor: Philip W. Newby, Mona Vale, Australia

[73] Assignee: W. R. Carpenter & Co. Ltd., Artarmon, Australia

[21] Appl. No.: 240,410

[22] Filed: Aug. 31, 1988

Related U.S. Application Data

[63] Continuation of Ser. No. 18,194, Feb. 24, 1987, abandoned.

[30] Foreign Application Priority Data

Feb. 28, 1986 [AU] Australia ..... PH4827

[51] Int. Cl.[4] ..... B66C 19/00

[52] U.S. Cl. ..... 212/71; 104/111

[58] Field of Search ..... 212/71, 73, 205, 219, 212/218; 238/220; 104/106, 110, 111, 118; 248/58, 60, 62, 65, 72, 74.2, 228, 231.8, 317

[56] References Cited

U.S. PATENT DOCUMENTS

| | | | |
|---|---|---|---|
| 831,942 | 9/1906 | Fenwick | 238/220 |
| 1,569,060 | 1/1926 | Wright | 104/111 |
| 1,759,213 | 5/1930 | Webb | 104/111 |
| 3,960,232 | 6/1976 | Hubbell | 248/58 |
| 4,112,550 | 9/1978 | DeWitt et al. | 248/228 |
| 4,471,867 | 9/1984 | Forshee | 104/111 |

FOREIGN PATENT DOCUMENTS

| | | |
|---|---|---|
| 368017 | 3/1932 | United Kingdom . |
| 371747 | 4/1932 | United Kingdom . |
| 386455 | 1/1933 | United Kingdom . |
| 398731 | 9/1933 | United Kingdom . |
| 404720 | 1/1934 | United Kingdom . |
| 517107 | 1/1940 | United Kingdom . |
| 638266 | 6/1950 | United Kingdom . |
| 680365 | 10/1952 | United Kingdom . |
| 1257469 | 12/1971 | United Kingdom . |
| 1257814 | 12/1971 | United Kingdom . |
| 1287878 | 9/1972 | United Kingdom . |
| 1581313 | 12/1980 | United Kingdom . |
| 2152971 | 8/1985 | United Kingdom . |

OTHER PUBLICATIONS

International Search Report Appln. No. 8704235, 5/20/87.

*Primary Examiner*—Sherman D. Basinger
*Assistant Examiner*—Stephen P. Avila
*Attorney, Agent, or Firm*—Ladas & Parry

[57] ABSTRACT

A girder support for a girder having a web and a top flange, the support is formed of extruded aluminium and is of a "T-shaped" configuration with a recess which encompasses the web and top flange, the support includes two legs between which the web is located, with the legs being resiliently movable away from each other to facilitate installation of the support.

3 Claims, 2 Drawing Sheets

MONORAIL AND FISHPLATE ASSEMBLY

This is a continuation of co-pending application Ser. No. 07/018,194, now abandoned, which was filed on Feb. 24, 1987.

The present invention relates to the support of beams and more particularly to the support of beams which act as a girder for a girder trolley.

Girders providing a support for a girder trolley have conventionally been attached to a support sructure by means of brackets welded to the top flange of the girder, which brackets are in turn welded to a support beam.

The abovediscussed girder support has the disadvantage that the loads are concentrated and considerable effort is required for assembling and disassembling of the girder trolley and its associated support structure.

It is the object of the present invention to overcome or substantially ameliorate the above disadvantages.

There is disclosed herein a girder support for a girder having a web with at least one flange extending transverse of the web so as to protrude therefrom, said support comprising a fishplate with a body defining a recess complementary to the transverse cross-section of said girder so as to encompass said flange and web to enable removably fixing thereto, said recess being at least partly defined between two legs between which the web is to be located, a mounting flange extending from said body enabling attachment of the support to a supporting structure.

A preferred form of the present invention will now be described by way of example with reference to the accompanying drawings, wherein.

Figure 1:
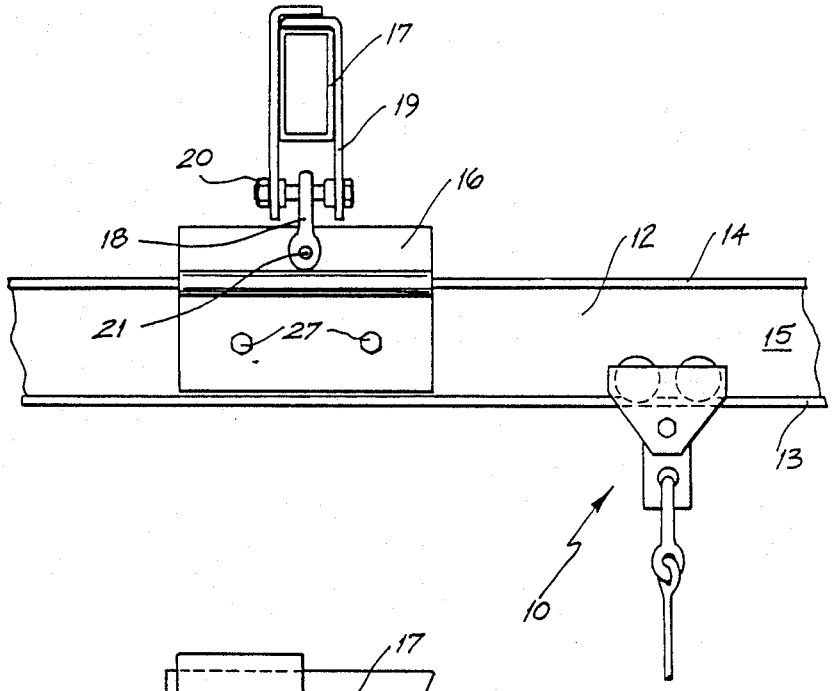
FIG. 1 is a schematic side elevation of a girder trolley, support girder and fishplate.
Figure 2:
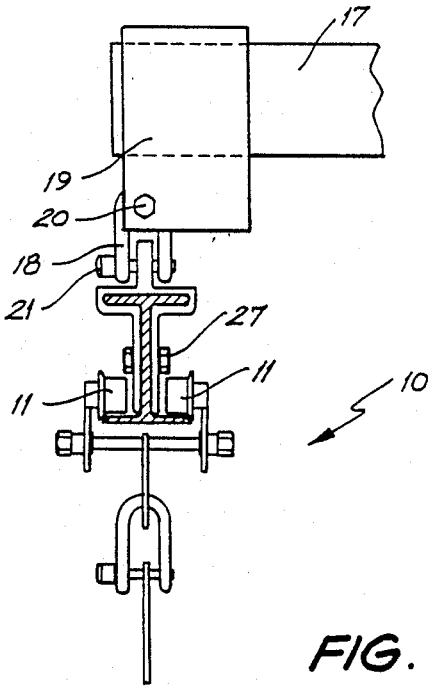
FIG. 2 is a schematic end elevation of the girder trolley and support therefor of FIG. 1.

In the accompanying drawings there is schematically depicted a girder trolley 10 having wheels 11 which are supported on a girder 12 having a bottom flange 13 and a top flange 14 joined by a web 15. The girder 12 is supported by one or more fishplates 16 which is in turn are supported on a beam 17 by means of a U-bolt 18 and support bracket 19. Extending between the legs of the support bracket 19 is a bolt 20 over which the U-bolt 18 passes. The U-bolt 18 receives a pin 21 which passes through the fishplate 16.

Figure 3:
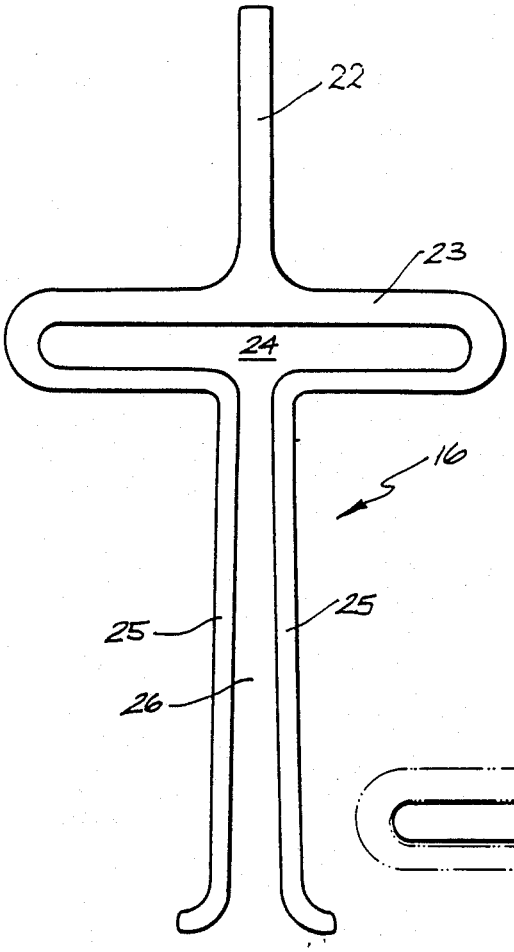
FIG. 3 is a schematic end elevation of the fishplate employed in Fig. 1.
Figure 4:
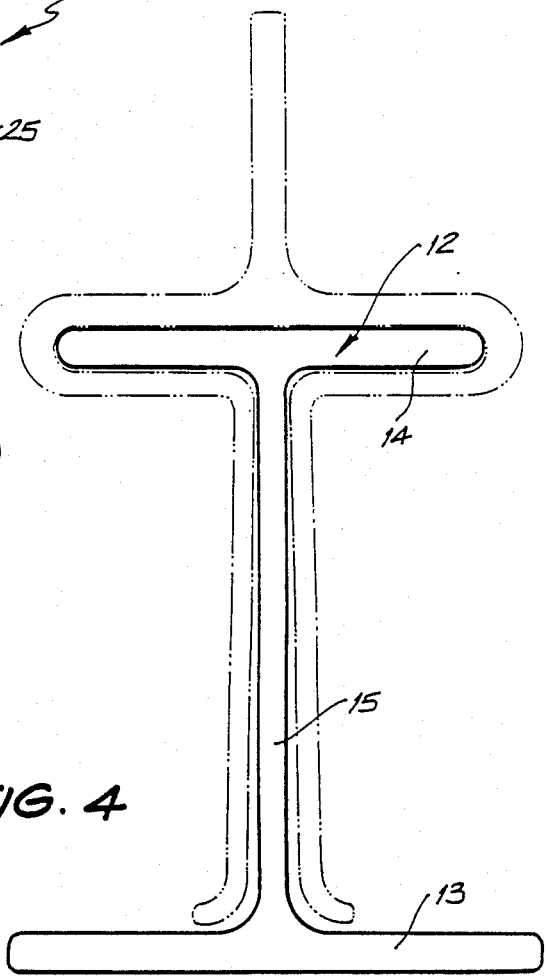
FIG. 4 is a schematic end elevation of the girder and fishplate employed in FIG. 1.

As best seen in FIGS. 3 and 4 the girder 12 has an "I" cross-section while the fishplate 16 has a body with a cross-section defining a T-shaped recess complementary to the cross-sectional shape of the web 15 and flange 14 so as to encompass the web 15 and flange 14. More particularly the fishplate 16 has a top vertical flange 22 through which the pin 21 passes, and portion 23 defining a recess 24 within which the flange 14 is located. Extending downwardly is a pair of legs 25 which define a recess 26 within which the web 15 is located. Passing through the legs 25 and the web 15 is one or more bolts 27.

It is preferred that the girder 12 and its associated fishplate 16 are formed of extruded aluminium. The fishplate 16 is resiliently deformable so as to facilitate installation by the outward deflection of the legs 25, thereby effectively enlarging the recesses 24 and 26.

I claim:

1. A girder support for a girder having a web with at least one flange extending transverse of the web so as to protrude therefrom, said support comprising a fish plate consisting of a unitary body of "T-shaped" configuration so as to have a base portion and a leg portion terminating at and extending normally from the base portion, said body being provided with a T-shaped recess complementary to the transverse cross section of a girder so as to encompass a flange and web portion thereof to enable removable fixing thereto, said body having a pair of generally parallel coextensive legs, providing said leg portion, and a hollow flange portion extending generally normal thereto and providing said base portion, with the flange portion providing a portion of said recess which encompasses said flange and said legs cooperating to define a further portion of said recess which encompasses said web, a mounting flange extending from said body enabling attachment of the support to a supporting structure, and wherein said body is formed of resilient material so that said legs are resiliently deflectable apart to facilitate installation and removal of the support on the girder by deflection of the legs apart thereby effectively increasing the cross sectional area of said recess.

2. The girder support of claim 1 wherein said fishplate body is formed from an extrusion.

3. The girder support of claim 2 wherein said fishplate body is extruded from aluminum.

* * * * *